US011725917B2

(12) United States Patent
Klaumünzer

(10) Patent No.: US 11,725,917 B2
(45) Date of Patent: Aug. 15, 2023

(54) PROJECTILE HAVING A CALIBER OF LESS THAN 13 MM AND A SYSTEM FOR TRACKING A PROJECTILE

(71) Applicant: RUAG Ammotec GmbH, Fürth (DE)

(72) Inventor: Martin Klaumünzer, Nuremberg (DE)

(73) Assignee: RUAG AMMOTEC GMBH, Fuerth (DE)

( * ) Notice: Subject to any disclaimer, the term of this patent is extended or adjusted under 35 U.S.C. 154(b) by 0 days.

(21) Appl. No.: 17/283,489

(22) PCT Filed: Feb. 4, 2020

(86) PCT No.: PCT/EP2020/052734
§ 371 (c)(1),
(2) Date: Apr. 7, 2021

(87) PCT Pub. No.: WO2020/161123
PCT Pub. Date: Aug. 13, 2020

(65) Prior Publication Data

US 2021/0396504 A1 Dec. 23, 2021

(30) Foreign Application Priority Data

Feb. 4, 2019 (DE) ..... 10 2019 102 722.5

(51) Int. Cl.
*F42B 12/36* (2006.01)

(52) U.S. Cl.
CPC ..... *F42B 12/365* (2013.01)

(58) Field of Classification Search
CPC ..... F42B 12/365
See application file for complete search history.

(56) References Cited

U.S. PATENT DOCUMENTS 4,495,851 A * 1/1985 Koerner ..... F42C 17/04 102/270
5,141,229 A * 8/1992 Roundy ..... H01H 35/14 473/578
5,167,417 A * 12/1992 Stacey ..... F42B 6/04 473/578
5,381,445 A * 1/1995 Hershey ..... G01S 5/0009 73/167
6,604,946 B2 * 8/2003 Oakes ..... F42B 12/365 102/444
6,679,179 B1 * 1/2004 Bohl ..... F41H 13/0093 102/210

(Continued)

FOREIGN PATENT DOCUMENTS

DE 35 18 117 A1 11/1986
DE 10 2012 021 449 A1 4/2014

(Continued)

OTHER PUBLICATIONS

International Search Report for PCT/EP2020/052734, dated Jun. 24, 2020, and English Translation submitted herewith (9 pgs.).

(Continued)

*Primary Examiner* — Derrick R Morgan
(74) *Attorney, Agent, or Firm* — Fitch, Even, Tabin & Flannery, LLP

(57) ABSTRACT

The present invention relates to a projectile having a caliber of less than 13 mm, comprising a bullet jacket defining a cavity and a position transmitter arranged in the cavity.

11 Claims, 1 Drawing Sheet

(56) References Cited

Figure 1:
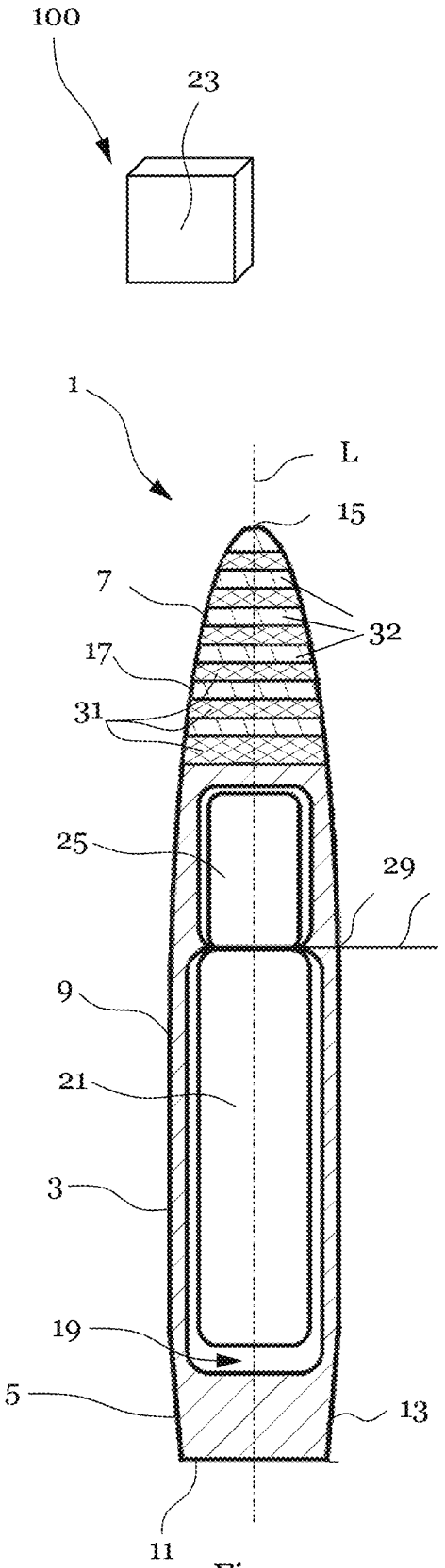

U.S. PATENT DOCUMENTS 7,621,062 B2 * 11/2009 Cugliari ..... F42B 35/00 42/1.01
8,984,999 B2 * 3/2015 Frick ..... F42C 11/065 102/209
9,200,877 B1 * 12/2015 Rubin ..... F42B 12/46
9,749,789 B1 * 8/2017 Edmonds ..... H04W 4/023
10,401,136 B1 * 9/2019 VanTassell ..... G01S 19/35
10,718,596 B1 * 7/2020 Weston ..... F42B 6/04
10,746,515 B1 * 8/2020 Parker ..... F42B 12/382
11,031,885 B1 * 6/2021 Yavid ..... F42B 12/02
2003/0171174 A1 * 9/2003 Price ..... F42B 6/06 473/578
2006/0213105 A1 * 9/2006 Cugliari ..... F42B 12/625 102/501
2006/0244612 A1 * 11/2006 Pridmore ..... F42B 12/382 340/573.2
2006/0283345 A1 * 12/2006 Feldman ..... F42B 12/365 102/501
2007/0105668 A1 * 5/2007 Kikos ..... F42B 12/385 473/578
2007/0142137 A1 * 6/2007 Davenhaver ..... F42B 12/385 473/578
2007/0262874 A1 * 11/2007 Sumrall ..... F42B 12/365 340/539.13
2008/0287229 A1 * 11/2008 Donahoe ..... F41B 5/14 473/578
2008/0289530 A1 * 11/2008 Adorjan ..... F42B 12/42 362/253
2009/0053678 A1 * 2/2009 Falkenhayn ..... F41A 33/00 434/16
2009/0195369 A1 * 8/2009 Fischbach ..... B60R 25/04 340/426.11
2011/0226038 A1 * 9/2011 Donahoe ..... F42B 12/365 73/12.05
2013/0220160 A1 * 8/2013 Burdine ..... F42B 12/385 124/56
2013/0291755 A1 * 11/2013 Hirlinger ..... F42B 8/12 102/513
2014/0083318 A1 * 3/2014 Tempi ..... F41A 19/62 102/215
2014/0266706 A1 * 9/2014 DiSanto ..... G08C 19/16 340/539.13
2015/0237239 A1 * 8/2015 Lyren ..... H04N 5/772 348/375
2015/0265917 A1 * 9/2015 Chang ..... F41J 5/00 463/7
2016/0109076 A1 * 4/2016 Blair ..... F42B 12/42 362/183
2016/0131464 A1 5/2016 Rubin
2016/0153758 A1 * 6/2016 Ledbetter ..... F42B 12/42 473/570
2016/0202028 A1 * 7/2016 Lyren ..... A01M 31/002 473/570
2016/0282474 A1 * 9/2016 Silvis ..... G01S 19/14
2017/0176156 A1 * 6/2017 Rubin ..... F42B 12/20
2018/0087883 A1 * 3/2018 Wynn ..... F21V 23/0407
2019/0093999 A1 * 3/2019 Parker ..... F42B 12/365
2019/0186882 A1 * 6/2019 Berseneff ..... F42B 4/28
2019/0226820 A1 * 7/2019 Vaguer ..... F42B 12/362
2019/0226821 A1 * 7/2019 Vaquer Tarrago ..... F41B 5/14
2019/0293397 A1 * 9/2019 Du ..... F42C 15/40
2019/0368847 A1 * 12/2019 Parker ..... F42B 12/382
2020/0056867 A1 * 2/2020 Roper ..... F42B 12/38
2020/0124385 A1 * 4/2020 Mercier ..... F42B 12/22
2021/0063129 A1 * 3/2021 Parker ..... G01H 1/00
2021/0095940 A1 * 4/2021 Pedicini ..... F42B 12/365
2021/0254937 A1 * 8/2021 Hoelzl ..... F41A 33/02
2021/0285748 A1 * 9/2021 Koontz ..... F42B 12/365

FOREIGN PATENT DOCUMENTS

DE 10 2012 022 894 A1 5/2014
WO 2017/141009 A1 8/2017

OTHER PUBLICATIONS

GPTO Office Action for DE 10 2019 102 722.5, dated Jan. 13, 2020.

* cited by examiner

PROJECTILE HAVING A CALIBER OF LESS THAN 13 MM AND A SYSTEM FOR TRACKING A PROJECTILE

CROSS-REFERENCE TO RELATED APPLICATIONS

This application is a U.S. national phase application filed under 35 U.S.C. § 371 of International Application No. PCT/EP2020/052734, filed Feb. 4, 2020, designating the United States, which claims priority from German Application No. 10 2019 102 722.5, filed Feb. 4, 2019, which are hereby incorporated herein by reference in their entirety.

The present invention relates to a projectile having a caliber of less than 13 mm. Further, the present invention relates to a system for tracking such a projectile.

When using firearms for hunting, it is necessary to locate the shot animal. This can be complicated by various circumstances. For example, it may happen that no trained bloodhound is available or that a non-lethal shot is applied, for example, in the twilight so that a subsequent search for the wounded animal is impossible. In hunting, therefore, there is a general need to facilitate to locate of shot animals, dead or alive.

In military-authority operations, it may be necessary to mark a target in order to track its position and/or to generate movement profiles.

In large-caliber applications, digitally trackable ammunition is known but with the goal of guiding and/or controlling the large-caliber projectile after it is fired. When the projectile hits a target, the large-caliber projectile ignites and is destroyed along with its electronics. The large size of large-caliber ammunition makes it possible to accommodate the electronics required for digital tracking of the projectile, such as a position transmitter and a power source, within the projectile. In the field of small-caliber ammunition, electronics integrated into the projectile do not yet exist. Furthermore, no solution exists so far in which the electronics remains intact after the projectile hits a target.

It is an object of the present invention to improve upon the disadvantages inherent in the known prior art, and in particular to provide a projectile with a caliber of less than 13 mm and a system for tracking such a projectile, the position of which can be tracked after the firearm has been fired.

Accordingly, a projectile having a caliber of less than 13 mm, preferably about 12.7 mm, less than 12 mm, 11 mm, 10 mm, 9 mm, 8 mm, 7 mm, or less than 6 mm is provided. The caliber is generally a measure of the outside diameter of a projectile and/or the inside diameter of a barrel of a firearm.

The projectile comprises a projectile jacket preferably of metal, metal alloys, for example comprising steel, brass, copper, lead, or the like. The projectile jacket may define the external shape of the projectile. Further, the projectile jacket may extend along a longitudinal axis of the projectile and/or be rotationally symmetrical with respect to a central axis of the projectile. The projectile jacket defines a cavity in its interior. This means that the projectile jacket may be partially hollow.

According to the invention, a position transmitter is arranged in the cavity. This allows the position of the projectile to be tracked after firing. The position transmitter can be configured to transmit position signals that can be detected by a position signal receiver, for example.

According to a further development of the present invention, telemetry transmitters can be used. In general, telemetry or telemetering can be the transmission of signals from a signal transmitter located at any location to a spatially separated location, in particular where the transmitted signals can be collected, recorded and/or evaluated. For example, the position transmitter may be a radio-frequency identification ("RFID") transponder. RFID transponders differ, for example, according to the transmission frequency, although according to the present invention there are no limitations in this respect. The structure of an RFID transponder may, for example, be as follows: an antenna, at least one circuit for receiving and transmitting (transceiver), such as a microcontroller, and a memory containing the preferably unchangeable identity of the projectile. Furthermore, it is possible that the position transmitter is a GPS transmitter ("Global Positioning System"). The global positioning system is a global navigation satellite system for position determination, i.e. a system for position determination on earth and in the air by receiving signals from navigation satellites and/or pseudolites.

Furthermore, GPS-based solutions may be used in which the position transmitter itself does not transmit position signals, but is implemented as a GPS receiver that receives radio waves of the GPS system, for example, from the satellite or pseudolite, and thus the position determination and tracking is performed by means of a runtime and distance determination or measurement with respect to the transmitter. It should be understood that any other type or kind of position transmitter is included in the disclosure content of the present application that is suitable for the purpose according to the invention, in particular the requirements regarding transmitting ranges in the kilometer range or globally, dimensioning and transmitting strength or quality, in order to be accommodated in the projectile jacket cavity and enable position detection.

To increase the transmitting and/or receiving power of the position transmitter, it may be provided that the projectile jacket has, at least in sections along a longitudinal direction of the projectile, a transmission section, preferably made of plastic, which is characterized by an increased permeability for signals, in particular electromagnetic waves, compared to the rest of the projectile jacket. The position transmitter can, for example, be assigned to the transmission section and/or arranged adjacent to the transmission section in the cavity in such a way that the position signals emitted by the position transmitter reach the outside via the transmission section. According to an exemplary further development, the projectile jacket serves as a device for emitting and/or receiving electromagnetic waves, in particular as a transmitting and/or receiving antenna. In this context, a contact, for example by means of a cable, may be established between the position transmitter and the projectile jacket. The position transmitter can, for example, have an output contact which is coupled to an input contact of the projectile jacket, in particular in such a way that the position signals generated by the position transmitter are radiated outwardly, in particular in the form of free-space waves, by means of the projectile jacket. According to a further development, the position signals are transmitted and/or received substantially exclusively via the coupling between the position transmitter and the projectile jacket. The position transmitter may be isolated/shielded against the transmission of position signals, such as electromagnetic waves, except for the coupling with the projectile jacket.

In an exemplary embodiment of the present invention, the position transmitter has a passive state in which the position transmitter does not transmit position signals. For example, the passive state is an unpowered or de-energized state in which the position transmitter is not receiving power, in particular is not powered. Further, the position transmitter may have an active state in which the position transmitter emits position signals. The active state may be characterized, for example, by the fact that the position transmitter is energized or powered, in particular supplied with energy. According to an alternative embodiment, the position transmitter can be supplied with power, i.e. energized, both in the passive state and in the active state, whereby a switch can be provided for switching between the active and passive states. Here, switching from the passive state to the active state may be referred to as activating the position transmitter, and switching from the active state to the passive state may be referred to as deactivating the position transmitter.

In another exemplary embodiment of the projectile of the invention, the position transmitter switches from the passive state to the active state immediately before or immediately after the firearm is fired. The inventors of the present invention have found that position tracking may be necessary only after the projectile has left the firearm, that is, after the firearm has been fired. According to a further embodiment, it may be provided that immediately before or immediately after the firing of the firearm, the position transmitter is supplied with electrical power.

According to an exemplary further development of the present invention, an energy source for supplying the position transmitter with energy, in particular for supplying the position transmitter with power, is arranged in the cavity. The energy source may be, for example, an electric battery, in particular a button cell. A button cell is generally an electrochemical cell, for example with a round cross-section, the height of which is smaller than the diameter, and which delivers voltages preferably between 1.35 and 3.6 volts. The small dimensions and sufficient voltage output of button cells allow their use in the cavity of a shell of a projectile according to the invention. Depending on the electrode material, silver oxide, mercury oxide or lithium, button cells can be distinguished. In another exemplary embodiment, the power source is free from an electrical contact with the position transmitter in the passive state and is in an electrical contact with the position transmitter in the active state.

In an exemplary embodiment of the present invention, the position transmitter, in particular the RFID transponder, is supplied with power by an external energy source.

For example, the position transmitter may be energizable by the external energy source with high frequency radio waves from the outside. This can be realized by exposing the RFID transponder to a high-frequency electromagnetic alternating field containing high-frequency energy that is used to power the RFID transponder.

In another exemplary embodiment of the projectile according to the invention, the position transmitter and, if applicable, the energy source is/are arranged in the projectile jacket cavity such that the position transmitter and, if applicable, the energy source remains/remain intact after impact of the projectile with a target. The behavior of the projectile upon or after impact of the projectile with the target may be referred to as terminal ballistics or target ballistics. According to the invention, the projectile has suitable terminal ballistics that allow the position transmitter to continue to transmit position signals for enabling tracking of the projectile after the projectile has impacted the target. The inventors of the present invention have identified that this can be accomplished by appropriately locating the position transmitter and, if necessary, the energy source in the cavity and/or by appropriately dimensioning the projectile jacket. For example, knowledge of the deformation behavior of the projectile, particularly the projectile jacket, can be used to appropriately size the projectile jacket and/or appropriately arrange the position transmitter and, if applicable, the energy source in the cavity. For example, the projectile jacket is dimensioned in such a way that the impact and deformation energy generated when the projectile hits the target is specifically dissipated in areas where the position transmitter and, if applicable, the energy source are not located.

In an exemplary embodiment, the projectile jacket has a nose-side ogive section and a tail section opposite the ogive section. The position transmitter may be located in the cavity on the tail side and the energy source may be located in the cavity on the nose side.

According to an exemplary further development of the present invention, a nose-side ogive section of the projectile jacket is arranged to absorb, in particular to absorb to a large extent, preferably at least 50%, 60%, 70% or at least 80%, of the impact and deformation energy resulting from the impact of the projectile on the target. For example, the ogive section comprises an absorber preferably made separately from the projectile jacket for absorbing the impact and deformation energy. It may further be provided that the impact and deformation energy is transferred to a tail section opposite the ogive section such that a base body of the projectile jacket connecting the ogive section to the tail section remains substantially intact. For example, the ogive section, the tail section and the base body are made of one piece, preferably of metal. By selectively transferring the impact and deformation energy between the ogive section and the tail section, it can be ensured, among other things, that the electronics located in the cavity, i.e., the position transmitter and, if applicable, the energy source, remain intact so that the position transmitter can transmit position signals for tracking even after the projectile has impacted the target. The absorber may, for example, be implemented as a layered structure or sandwich structure and/or comprise a sequence of at least two layers, preferably of metal, of different density and/or a different coefficient of expansion. In this way, the impact and deformation energy can be advantageously received, in particular absorbed and/or dissipated.

In another exemplary further embodiment, an electrical insulator is arranged between the position transmitter and the power source for temporarily preventing an electrical contact. In particular, the electrical insulator prevents an electrical contact in the passive state of the position transmitter, and in particular, the electrical insulator ensures the passive state. For example, the electrical isolator is arranged such that when the isolator is removed, the position transmitter is activated. This can ensure that the position transmitter is switched/activated to the active state only at a certain point in time. For example, the isolator is to be removed immediately before or immediately after firing the firearm. Further, it may be provided that heat generated during firing of the firearm causes dissolution, preferably melting, of the electrical insulator, preferably to establish an electrical contact between the power source and the position transmitter and/or to activate the position transmitter.

According to an exemplary further embodiment, the position transmitter and the energy source are arranged at a distance from each other in such a way that, when the projectile impacts a target, the impact and deformation energy causes a nose-side deformation of the projectile jacket, in particular of the ogive section, as a result of which the electrical contact between the position transmitter and the energy source is established. According to this exemplary embodiment, the position transmitter is activated upon impact of the projectile with a target, so that position determination of the projectile is possible from the moment of impact.

In a further exemplary embodiment of the projectile according to the invention, the position transmitter is separated from the energy source by a compartment wall, in particular made in one piece with the projectile jacket, dividing the cavity into two compartments. The compartment wall can be used to ensure the passive state of the position transmitter, in particular to prevent an electrical contact between the position transmitter and the energy source. For example, the compartment wall is adapted to deform, in particular to destroy, upon impact of the projectile with a target such that an electrical contact between the position transmitter and the energy source is established. Furthermore, the compartment wall can be dimensioned in such a way that the impact and deformation energy resulting from the impact of the projectile on the target and transmitted from a nose-side ogive section via the projectile jacket into the compartment wall causes the compartment wall to deform, in particular to be destroyed.

According to an exemplary further development of the present invention, a nose-side ogive portion of the projectile jacket comprises an applicator, preferably made of metal, such as lead, steel, copper, or the like, which, when the projectile hits a target, presses the position transmitter in the direction of the energy source or presses the energy source in the direction of the position transmitter to establish an electrical contact. In this regard, it may be provided that the applicator is made of a different material, in particular of different density and/or a different coefficient of expansion, as the material of the projectile jacket. For example, the applicator may press the position transmitter in the direction of the energy source or the energy source in the direction of the position transmitter while deforming, preferably destroying, the compartment wall.

In another exemplary embodiment of the projectile according to the invention, the position transmitter and/or the energy source are/is arranged loosely in the cavity in such a way that acceleration forces occurring during firing of the firearm and acting on the projectile cause the position transmitter to come into an electrical contact with the energy source. Loosely arranged may mean, for example, that no fastening, in particular axial fastening in the longitudinal direction of the projectile, is provided for the energy source and/or the position transmitter. Furthermore, loosely arranged may mean that the cavity of the projectile jacket is provided with a holding device for holding the energy source and/or the position transmitter in such a way that before firing the firearm the energy source and/or the position transmitter is/are substantially fixed to the projectile jacket and after firing the firearm the energy source and/or the position transmitter detach(es) from the holding device in order to be able to establish the electrical contact. For example, the retaining device may be overcome, for example destroyed, due to the acceleration forces acting on the projectile. Furthermore, it can be provided that acceleration forces occurring during firing of the firearm and acting on the projectile cause the position transmitter and/or the energy source to move in the direction of the other in order to establish the electrical contact.

According to another aspect of the present invention, which may be combined with the preceding aspects and exemplary embodiments, there is provided a system for tracking a projectile having a caliber of less than 13 mm. The system according to the present invention comprises a projectile configured according to any of the previously described aspects or exemplary embodiments, and a position signal receiver for receiving position signals transmitted by the position transmitter of the projectile. It may be provided that, depending on the position transmitter used, a corresponding position signal receiver is used that is adapted to receive, process and/or evaluate the position signals emitted by the position transmitter. Furthermore, the position signal receiver can have suitable software which can be implemented depending on the area of application of the system according to the invention.

Preferred embodiments are given in the dependent claims.

Figure 2:
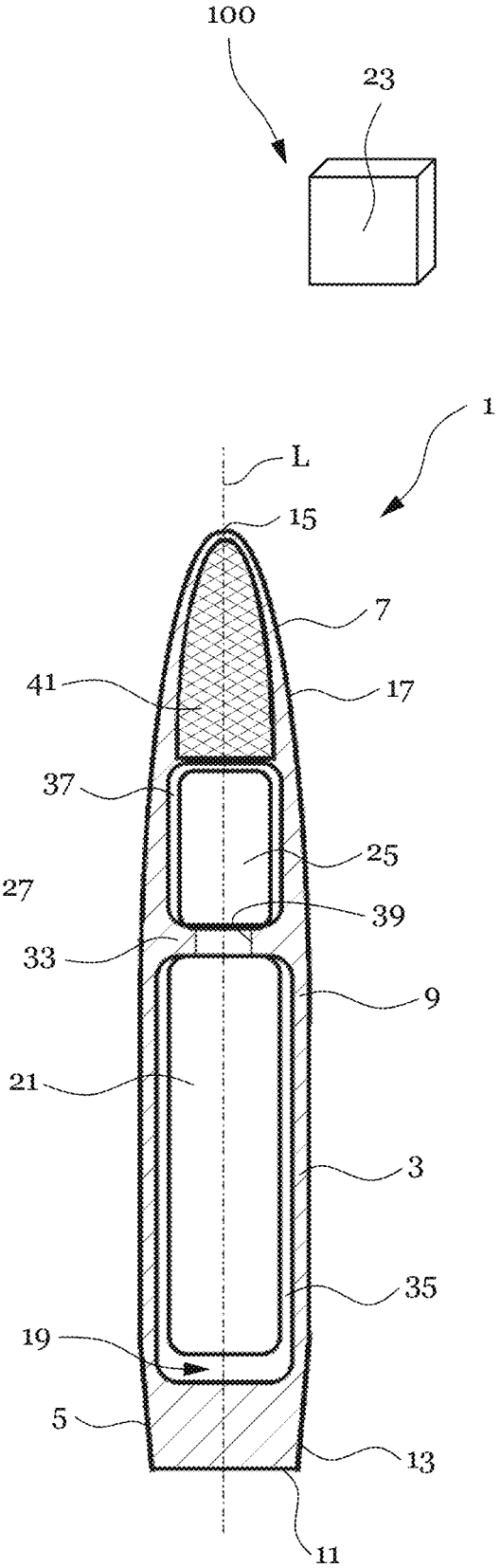

In the following, further configurations, features and advantages of the invention will become apparent by means of the description of preferred embodiments of the invention with reference to the accompanying exemplary drawings, in which show:

FIG. 1 a schematic sectional view of a projectile according to the invention; and FIG. 2 a schematic sectional view of a further embodiment of a projectile according to the invention.

In the following description of exemplary embodiments, a projectile according to the invention having a caliber of less than 13 mm, preferably of about 12.7 mm, is generally indicated with the reference numeral 1.

With reference to FIG. 1, a first exemplary embodiment of the projectile 1 according to the invention is shown in a schematic sectional view. The projectile 1 has a projectile jacket 3 which essentially defines the outer shape of the projectile 1. The projectile jacket 3 extends along a longitudinal axis L of the projectile and is designed to be essentially rotationally symmetrical with respect thereto. The projectile 1 or the projectile jacket 3 is divided essentially into three sections preferably made of one piece, in particular metal: a tail section 5 on the tail side, an ogive section 7 on the nose side, and a base body 9 connecting the tail section 5 and the ogive section 7. The tail section 5 is mostly made of solid material, preferably metal, and forms at the tail end a tail surface ii oriented essentially perpendicular to the longitudinal direction L of the projectile, from which a projectile tail jacket surface 13 being inclined with regard to the longitudinal axis of the projectile L extends in the direction of the projectile nose. The projectile rear surface 13 merges in the longitudinal direction of the projectile L into the base body 9, which has a substantially constant cross-sectional shape with a constant wall thickness. On the nose side, the base body 9 opens into the ogive section 7, which has a circumferential projectile nose jacket surface 17 being curved towards a projectile tip 15.

The projectile jacket 3 delimits in its interior a cavity 19 which extends over at least 50% of a dimension of the projectile 1 in the longitudinal direction of the projectile L, preferably at least 60% or at least 70%. According to the invention, a position transmitter 21 is accommodated in the cavity 19, which is adapted to transmit position signals so that the position of the projectile 1 can be tracked. FIG. 1 also schematically shows a position signal receiver 23 for receiving the position signals emitted by the position transmitter 21 to form a system 100 according to the invention for tracking a projectile 1. Furthermore, a power source 25, which may be a button cell for example, for supplying power to the position transmitter 21 is accommodated in the cavity 19.

Further referring to FIG. 1, an electrical insulator 27 is disposed between the position transmitter 19 and the power source 25 for temporarily preventing an electrical contact of the position transmitter 19 and the power source 25. The electrical insulator 27 prevents an electrical contact in the passive state of the position transmitter 19. To activate the position transmitter 19, the electrical insulator 27 must be removed. This can be accomplished, for example, by manually pulling the insulator 27 out of the cavity 19. For example, the projectile jacket 3 includes an opening 29 from which the insulator 27 partially protrudes to be grasped by a user to pull the insulator 27 out of the cavity 19 via the opening 29. This can ensure that the position transmitter 19 is only switched/activated to the active state at a specific time, preferably immediately prior to the firing of the firearm, which is not shown in greater detail.

Furthermore, the ogive section 7 of the projectile jacket 3 comprises an absorber 31, 32, preferably made separately from the projectile jacket, for absorbing, in particular for the most part, preferably at least 50%, 60%, 70% or at least 80%, of the impact and deformation energy resulting from the impact of the projectile 1 on the target. The absorber 31, 32 can transfer the impact and deformation energy into the tail section 5 in such a way that the base body 9 and especially the electronics arranged in the cavity 19, i.e. the position transmitter 21 and the energy source 25, remain substantially undamaged. As exemplified in FIG. 1, the absorber 31, 32 may comprise a layered structure or sandwich structure. A sequence of layers/films arranged consecutively in the longitudinal direction of the projectile L may be provided, for example a sequence of metal layers of different density and/or a different coefficient of expansion may be provided. For example, the absorber 31, 32 is realized as a sequence of an absorption layer 31 and an absorption layer 32, wherein the absorption layer 32 has a different density and/or a different coefficient of expansion compared to the absorption layer 31.

With reference to FIG. 2, a further exemplary embodiment of the projectile 1 according to the invention is described. To avoid repetition, the same components are given the same reference number and the following description is limited to the differences compared with FIG. 1. Instead of the electrical insulator 27, the position transmitter 21 and the energy source 25 are arranged at a distance from one another with respect to the longitudinal direction L of the projectile. According to the exemplary embodiment shown in FIG. 2, the spacing is realized by a compartment wall 33 made in particular in one piece with the projectile jacket 3, which divides the cavity 19 into a tail-side compartment 35 and a nose-side compartment 37. It can be seen that the position transmitter 21 is arranged in the tail-side compartment 35 and the energy source 25 is arranged in the nose-side compartment 37. The compartment wall 33 may, for example, be formed continuously of solid material or may, for example, have a through opening 39 approximately in the center. The compartment wall 33 can be used to ensure the passive state of the position transmitter 19, in particular to prevent an electrical contact between the position transmitter 19 and the energy source 25. Upon impact of the projectile 1 with a target, the compartment wall 33 deforms in such a way that an electrical contact between the position transmitter 19 and the energy source 25 is established. For example, the impact and deformation energy transmitted from the ogive section 7 via the projectile jacket 3 into the compartment wall 33 during impact of the projectile 1 on the target can cause a deformation, in particular a destruction, of the compartment wall 33, so that an electrical contact between position transmitter 21 and the energy source 25 is established, for example, by moving the position transmitter 21 and the energy source 25 towards each other in the longitudinal direction L of the projectile.

Further referring to FIG. 2, the ogive section 7 comprises an applicator 41, which is preferably made separately from the projectile jacket 3. Upon impact of the projectile 1 on a target, the applicator 41 pushes the energy source 25 substantially in the longitudinal direction of the projectile L towards the position transmitter 21 to establish an electrical contact. This may be done while deforming, preferably destroying, the compartment wall 33.

The position signal receiver 23 may be selected depending on the position transmitter 21 used to receive, process and/or evaluate the position signals transmitted by the position transmitter 21. Furthermore, the position signal receiver 23 may have software, not shown in more detail, which may be implemented depending on the field of application of the system 100 according to the invention.

The features disclosed in the foregoing description, figures, and claims may be significant, both individually and in any combination, for the realization of the invention in the various embodiments.

REFERENCE SIGN LIST

1 Projectile
3 Projectile jacket
5 Tail section
7 Ogive section
9 Base body
11 Rear surface
13 Projectile tail jacket surface
15 Projectile tip
17 Projectile nose jacket surface
19 Cavity
21 Position transmitter
23 Position signal receiver
25 Energy source
27 Insulator
29 Opening
31, 32 Absorber
33 Compartment wall
35, 37 Compartment
39 Passage opening
41 Applicator
100 System
L Projectile longitudinal axis

The invention claimed is:

1. A projectile with a caliberof less than 13 mm, comprising a projectile jacket defining a cavity, and a position transmitter and an energy source for supplying powerto the position transmitter arranged in the cavity, wherein an electrical insulator is arranged between the position transmitterand the energy source for temporarily preventing an electrical contact in a passive state, and wherein the position transmitter is configured to be switched from the passive state to an active state immediately before firing of the firearm by removal of the insulatorfrom between the position transmitter and the energy source.

2. The projectile according to claim 1, wherein the position transmitterand the energy source is/are arranged in the projectile jacket cavity such that the position transmitter and the energy source remains/remain intact after impact of the projectile with a target.

3. The projectile according to claim 1, wherein the projectile jacket has a nose-side ogive section and a tail section opposite the ogive section, wherein the position transmitter is accommodated in the cavity on the tail side and an energy source for supplying power to the position transmitter is accommodated in the cavity on the nose side.

4. The projectile according to claim 1, wherein a nose-side ogive section of the projectile jacket is configured to absorb the impact and deformation energy resulting from the impact of the projectile on a target and/or to transfer the impact and deformation energy into a tail section opposite the ogive section in such a way that a base body of the projectile casing connecting the ogive section to the tail section remains substantially undamaged.

5. A system for tracking a projectile, comprising a projectile according to claim 1 having a caliber of less than 13 mm and a position signal receiver for receiving position signals transmitted by the position transmitter.

6. The projectile according to claim 1, wherein position transmitter comprises a GPS transmitter, a telemetry transmitter or an RFID transponder.

7. The projectile according to claim 1, wherein the energy source is an electric battery.

8. The projectile according to claim 1, wherein the energy source is a button cell electric battery.

9. The projectile according to claim 1, wherein the projectile is configured to hit a target.

10. The projectile according to claim 9, wherein the projectile wherein the projectile jacket has a nose-side ogive section and a tail section opposite the ogive section.

11. The projectile according to claim 1, wherein the projectile wherein the projectile jacket has a nose-side ogive section and a tail section opposite the ogive section.

* * * * *